US005966755A

United States Patent [19]

Pittman

[11] Patent Number: 5,966,755

[45] Date of Patent: Oct. 19, 1999

[54] AIR/WATER MATTRESS FOR A TRUCK BED

[76] Inventor: James J. Pittman, 16522 Wilkie Ave., Torrance, Calif. 90504

[21] Appl. No.: 09/090,267

[22] Filed: Jun. 4, 1998

[51] Int. Cl.[6] ..... A47C 17/80

[52] U.S. Cl. ..... 5/118; 5/706; 5/902

[58] Field of Search ..... 5/118, 119, 420, 5/706, 902

[56] References Cited

U.S. PATENT DOCUMENTS

| | | | |
|---|---|---|---|
| D. 179,241 | 11/1956 | Burton et al. . | |
| D. 310,343 | 9/1990 | Angerer . | |
| D. 353,967 | 1/1995 | Moore . | |
| 2,648,072 | 3/1953 | De Blieux . | |
| 3,360,806 | 1/1968 | Dunaway | 5/118 |
| 4,091,149 | 5/1978 | Oxendine . | |
| 4,136,412 | 1/1979 | Wilhelm . | |
| 4,723,329 | 2/1988 | Vaccaro . | |
| 4,766,626 | 8/1988 | Green | 5/420 |
| 4,835,800 | 6/1989 | Johnson | 5/420 |
| 5,115,525 | 5/1992 | Lovitt . | |
| 5,185,896 | 2/1993 | Bonda . | |
| 5,544,373 | 8/1996 | Chang . | |
| 5,632,291 | 5/1997 | Botbyl et al. . | |

FOREIGN PATENT DOCUMENTS

| | | |
|---|---|---|
| 122 806 | 2/1919 | United Kingdom . |
| 1 545 325 | 5/1979 | United Kingdom . |
| 2 105 984 | 4/1983 | United Kingdom . |

*Primary Examiner*—Michael F. Trettel
*Attorney, Agent, or Firm*—Richard C. Litman

[57] ABSTRACT

A custom fit, inflatable air mattress, having a unitary, or one piece structure, that can be used in a variety situations such as in the flatbed of a pickup truck, station wagon, van or the like, and is designed to accurately and snugly conform around the protruding wheel well compartments.

2 Claims, 3 Drawing Sheets

AIR/WATER MATTRESS FOR A TRUCK BED

BACKGROUND OF THE INVENTION

1. Field of the Invention

The present invention relates to a custom fit, unitary inflatable air mattress, in particular to an inflatable air mattress for use in the bed of a vehicle such as a pickup, that conforms around the wheel well compartments. The invention further contemplates the use of water, rather than air, to fill the inflatable mattress.

2. Description of the Related Art

Certain types of vehicles such as pickup trucks, vans and station wagons have flatbeds that are normally used to carry cargo or the like. Flatbeds or beds also contain cumbersome protruding wheel well compartments that can greatly impinge on the size and shape of the cargo that can fit in the flatbed. Furthermore, when such vehicles are changed over and utilized for the transportation passengers, or used as sleeping quarters in the course of a trip requiring a prolonged or over night stay, the transformation of the flatbed from a working storage area to a comfortable sleeping or reclining quarters can be problematic and uncomfortable at best. When attempting to accommodate passengers whom desire to use this converted space, the protruding wheel well compartments represent an inherent problem by getting in the way of and diminishing what limited comfort various types of coverings and padding, unable to fit around the wheel wells, can provide. Another inherent problem in this type of changeover is that flatbeds are frequently dirtied by use, are hard and uncomfortable. Attempts have been made to use various cloth and/or plastic coverings but these solutions usually move or slide about to easily, are unable to appropriately accommodate the protruding wheel well compartments and simply do not supply enough comfort. Some attempts at providing various solutions to these and related problems, as addressed in the prior art, are as follows.

U.S. Design Pat. No. Des 179,241 issued on Nov. 20, 1956 to Burton et al demonstrates a multi-bodied, ornamental design inflatable mattress. It is unclear how or where the inflation of this mattress occurs.

U.S. Pat. No. 4,091,149 issued on May 23, 1978 to Oxendine teaches a multi-bodied pad for use in vehicles having a flat bed, but fails to teach an inflatable air mattress for use in the bed of a flat bed truck.

U.S. Pat. No. 5,185,896 issued on Feb. 16, 1993 to Bonda teaches an inflatable mattress used for sleeping in a car that increases the surface area of the rear seat by conforming to the floor of the automobile between the front and back seats, and is adjustable in order to compensate for the drive shaft hump on the floor of the car.

U.S. Pat. No. 5,544,373 issued on Aug. 1996 to Chang teaches an inflatable plastic and flannel air cushion, used for sleeping, that provides a cushioned and flattened surface over a car's driver and passenger's seat when all seats are in the flattened position and headrests have been removed.

U.S. Pat. No. 2,648,072 issued on Mar. 30, 1951 to DeBlieux teaches an inflatable cushion for use as a bed in automobiles. The cushion is located in the car such that it overhangs the rear seat, it is supported by a member on the floor of the car and it extends between the side doors and/or walls of the car.

None of the above inventions and patents, taken either singularly or in combination, is seen to describe the instantly disclosed unitary inflatable air mattress invention. Thus, an easy to inflate air mattress, designed for use in vehicles having a flatbed and capable of solving the aforementioned problems is desired.

SUMMARY OF THE INVENTION

Accordingly, it is a principal object of this invention to provide a custom fit, inflatable air mattress, having a unitary or one piece structure, that can be used in a variety situations such as in the flatbed of a pickup truck, a station wagon, a van or the like, and is designed to accurately and snugly conform to protruding wheel wells.

It is another object of the invention to provide an inflatable mattress that can be used with variety of small, medium and large sized vehicles having long or short flatbeds with protruding wheel wells.

Still another object of the invention is to provide an inflatable mattress having an air/water valve that is easily accessible and is located on the mattress such that when the mattress is situated in a flatbed, the nozzle is located at or near the tailgate, rear door or hatch of the vehicle.

It is further an object of the invention to provide an inflatable mattress that can be inflated with water rather than air.

It is an object of the invention to provide improved elements and arrangements thereof for the purposes described which are inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
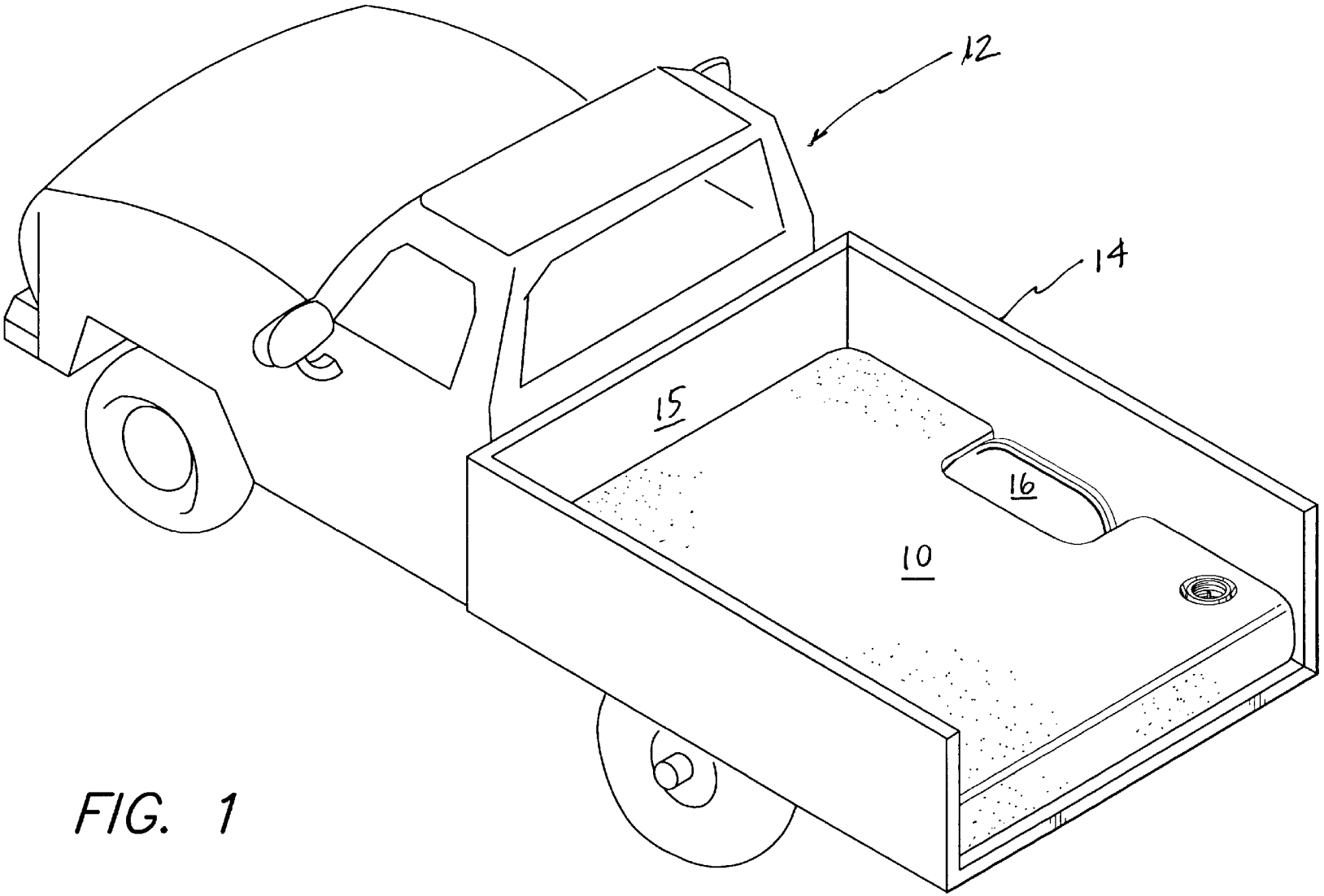
FIG. 1 is an environmental, perspective view of an air mattress according to the present invention, located in a truck bed.
Figure 2:
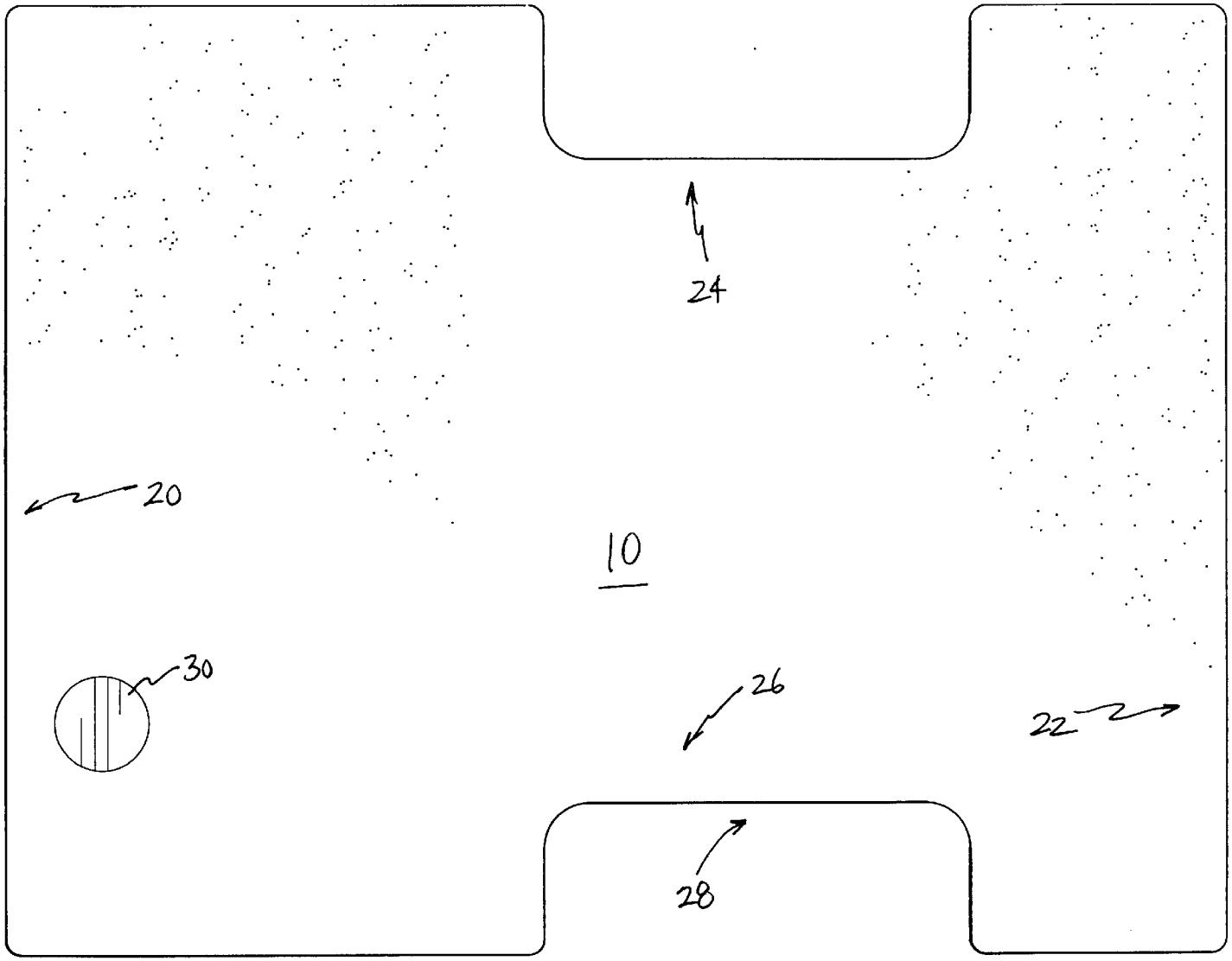
FIG. 2 is a top view of an inflatable air mattress demonstrating a unitary construction, wherein the nozzle is located nearest the rear of the mattress—where the mattress meets the tailgate or the like—and the mattress is sized and shaped such that it can conform around protruding wheel wells compartments.
Figure 3:
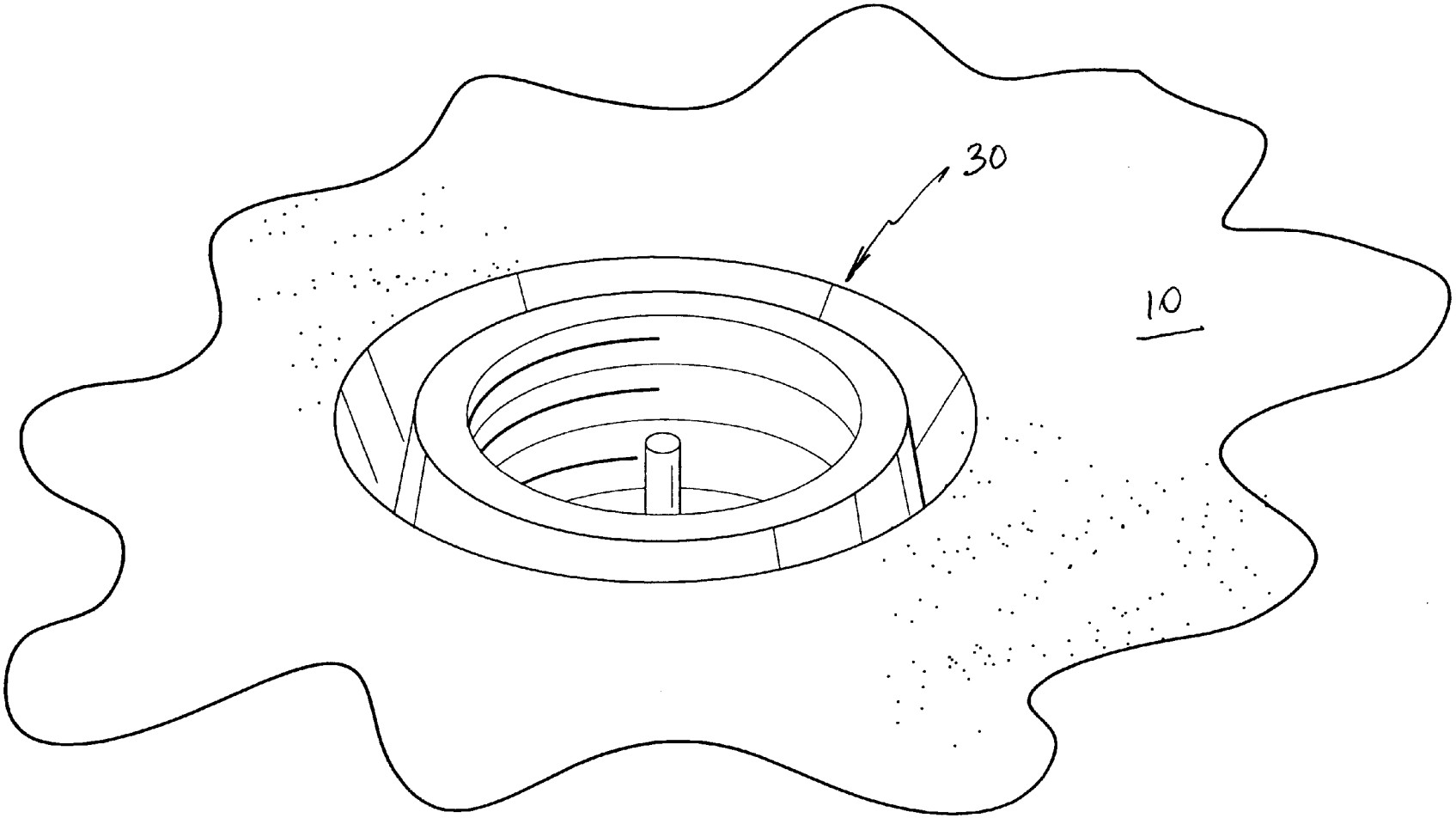
FIG. 3 is a view of a typical air/water nozzle of the kind that can be used in the presently disclosed air mattress.

Referring to the drawings and particularly FIGS. 1 and 2, there is illustrated a custom fit, inflatable, unitary air mattress overlying the bed 14 of a pickup truck 12. The inflatable mattress 10 is custom designed to conform precisely to the vehicle bed 14 for which it is intended to be used, and to specifically and snugly conform around the wheel well compartments 16 found protruding in the bed 14.

The inflatable mattress 10 comprises a substantially rectangular base portion having a rear 20, a front 22 and two side portions 24,26. The side portions 24,26 contain lateral recesses 28 or cut out portions individually measured such that each recess snugly conforms around the wheel well 16 compartments located in the bed 14 of the vehicle. A beneficial aspect of the current invention is that it has a unitary, single body construction, avoiding the cumbersome multi-paneled pad and mattress construction often seen in prior art. The disclosed inflatable mattress 10 is designed such that the air/water nozzle 30 is located at the rear 20 of the mattress 10, that is the side of the mattress that is to be located nearest the tailgate, hatch or rear door in order to facilitate easy inflation of the mattress with water or air.

In the preferred embodiment, the mattress 10 is made from a conventional vinyl material or other suitable, pliable, durable plastic. The thickness of the mattress 10 may vary according to the vehicle for which it is intended to be used with and based upon the desired amount of cushioning and support that the mattress is to demonstrate. The other dimensions of the custom fit mattress will be dependent upon the make and model of vehicle 12 with which it is to be used with because these dimensions vary from vehicle to vehicle. However, the front and rear portions 22,20 must be defined as those portions which, respectively, are sized with reference to the distances defined between the front bed panel 15, or similar barrier, and the wheel well 16, and, the rear gate (not shown) and wheel well 16.

While the air mattress 10 has been referred to as having a "substantially rectangular" shape, it should be noted that the base portion may have another desired shape, dependent upon the structure that the air mattress is to be used with, so long as the air mattress is custom fit to snugly fit protruding wheel well compartments 16, maintains a single or unitary construction and the air/water nozzle is located on the mattress such that it is near the tailgate, hatch or rear door for easy access.

It is to be understood that the present invention is not limited to the embodiments described above, but encompasses any and all embodiments within the scope of the following claims.

I claim:

1. A custom fit, tightly fitting, unitary one-piece, inflatable air mattress in combination with a motor vehicle, the combination comprising:

a motor vehicle having a substantially rectangular flatbed having a plurality of protruding wheel well compartments and a tailgate;

a one-piece inflatable air mattress having a substantially rectangular unitary base containing a front, a rear, an upper surface, a lower surface, and two side portions wherein said mattress is tightly located within the flatbed of said motor vehicle and covers the entire flatbed;

the side portions of said mattress contain lateral recesses that precisely conform to the protruding wheel well compartments located in the flatbed of said vehicle and an air nozzle located near said rear and on said upper surface of said mattress;

wherein the rear of said mattress is located adjacent to the tailgate of said vehicle when said mattress is placed in a bed of vehicle.

2. A custom fit, tightly fitting, unitary one-piece, fluid fillable mattress in combination with a motor vehicle, the combination comprising:

a motor vehicle having a substantially rectangular flatbed having a plurality of protruding wheel well compartments;

a one-piece fluid fillable mattress having a substantially rectangular unitary base containing a front, a rear and two side portions wherein said mattress is tightly located within the flatbed of said motor vehicle and covers the entire flatbed;

the side portions of said mattress contain lateral recesses that precisely conform to the protruding wheel well compartments located in the flatbed of said vehicle; and filler means selected from the group consisting of an air filler fitting and a water filler fitting, wherein said filler means is located on and through a predetermined location on said mattress for the introduction of fluid into said mattress.

* * * * *